United States Patent [19]

Trieste et al.

[11] Patent Number: 4,717,162

[45] Date of Patent: Jan. 5, 1988

[54] SEALING STRIP FOR BRIDGING AN EXPANSION JOINT

[76] Inventors: Mario Trieste; James J. Whelan, II, both of 23 Oakdale Pl., Massapequa Park, N.Y. 11762

[21] Appl. No.: 51,452

[22] Filed: May 19, 1987

[51] Int. Cl.[4] ..... F16J 15/10; E01C 11/10

[52] U.S. Cl. ..... 277/205; 277/207 R; 404/64

[58] Field of Search ..... 277/205, 207 R, 237; 404/64–66

[56] References Cited

U.S. PATENT DOCUMENTS

| | | | |
|---|---|---|---|
| 3,606,826 | 9/1971 | Bowman et al. | 404/64 X |
| 3,765,784 | 10/1973 | Watson et al. | 404/64 |
| 3,881,834 | 5/1975 | Bowman | 277/207 R X |
| 4,141,189 | 2/1979 | Borjeson | 277/205 X |
| 4,457,522 | 7/1984 | Trieste et al. | 277/205 |
| 4,522,413 | 6/1985 | Nicholas | 404/64 X |

FOREIGN PATENT DOCUMENTS

| | | | |
|---|---|---|---|
| 956706 | 4/1964 | United Kingdom | 404/65 |
| 2093885 | 9/1982 | United Kingdom | 404/65 |

*Primary Examiner*—Robert S. Ward
*Attorney, Agent, or Firm*—Myron Amer

[57] ABSTRACT

An elastomeric seal having substantially hollow body having a polygonal cross section formed by a bottom wall, a pair of opposed spaced side walls, a top wall and a plurality of internal supporting struts symmetrically arranged about the center of the polygonal cross section. The top wall is formed of a pair of arms extending in a V to each other, the apex of which lies along the center line between the side walls. The side walls are themselves bent inwardly intermediate their ends to extend perpendicular to the respective arms of the top walls. Compression of the parallel side walls, toward each other, causes the inwardly bent portions of the side walls to rotate outwardly resulting in a raising of the apex of the top wall so that the top wall assumes a flat configuration. Also assuming a flat configuration are flanges attached to extend outwardly from each of the side walls and, having as one result, the prevention of seepage of water between the sides of the seal and the sides of the groove in which it is placed.

6 Claims, 7 Drawing Figures

SEALING STRIP FOR BRIDGING AN EXPANSION JOINT

BACKGROUND OF THE INVENTION

The present invention relates to an expansion groove seal and in particular, to an improved elastomeric sealing strip for bridging the expansion joint between concrete structural elements on roadways, floors and the like.

In general, the expansion joint between concrete structural elements, are formed by providing a groove or a space between the concrete elements which is intended to accommodate extreme dimensional changes in the elements due to temperature variation. To seal and bridge these joints against the entry of dirt, ice, foreign objects and the like, a elastomeric strip is set within the groove between the element. The strips are adapted to compress and relax in response to variations in the size of the groove or spaces created by the dimensional changes. Thus, the elastomeric strip must be formed with an internal wall structure which permits it to readily expand and contract over an extended period of time. In an earlier co-inventor Trieste patent, U.S. Pat. No. 4,457,522, issued July 3, 1984, he disclosed an elastomeric sealing strip which not only had the strength to withstand repeated changes, due to variations in weather and temperature conditions, but which also enabled a more economic fabrication of the strip by extrusion processes.

A problem with the known elastomeric strip seals arises from the fact that in the process of contracting and relaxing, it has a tendency to rise and fall with respect to the plane of the roadway or floor, thereby causing its top surface either to form a bump or a depression in the surface. While such a defect is annoying in a roadway when a vehicle rides over the expansion joint, it is highly dangerous in the floor of a parking garage, or entrance way to buildings or the like, where pedestrians walk, since the pedestrian is likely to trip and fall while walking over the expansion joint. In addition, the rise and fall of the sealing strip gives rise to the accumulation of dirt and ice leading to a more rapid deterioration of the seal.

Also, seepage of water between the walls of the expansion groove and the sides of the seal could not be effectively prevented, and this detracted from the effectiveness of the seal.

It is an object of the present invention to provide an improved elastomeric sealing strip for bridging expansion joints, which overcome the defects and disadvantages of the prior art.

It is a further object of the present invention to provide an elastomeric sealing strip for structural elements which provides a smooth upper surface generally planar with respect to the roadway surface created by the structural elements.

It is still a further object of the present invention to provide for an elastomer sealing strip for expansion joints which is securely imbedded within the structural element so that it does not loosen or become dislodged even after extended depression and relaxation.

These objects, as well as other objects and advantages, will be apparent from the following disclosure of the present invention.

SUMMARY OF THE INVENTION

According to the present invention, an elastomeric sealing strip is provided comprising an elongated substantially hollow body having a polygonal cross section formed by a bottom wall, a pair of opposed spaced side walls, a top wall and a plurality of internal supporting struts symmetrically arranged about the center of the polygonal cross section. The top wall is formed of a pair of arms extending in a V to each other, the apex of which lies along the center line between the side walls. The side walls are themselves bent inwardly intermediate their ends to extend perpendicular to the respective arms of the top walls. As a result, compression of the parallel side walls toward each other, cause the inwardly bent portions of the side walls to rotate outwardly resulting in a raising of the apex of the top wall so that the top wall assumes a flat configuration, the free ends of the top wall being adapted to be embedded within the material forming the flooring or roadway structural element.

Each of the arms of the top wall are preferably provided with portions extending beyond the side walls and provided with lips at their end which can be embedded within the material of the flooring. In addition, is is preferred that a flat extending flange be formed to extend outwardly from the upper portion of the side wall and perpendicularly thereto, intermediate the upper wall and the fulcrom point so that upon straightening of the upper portion of the side wall, the flange extends perpendicularly thereto and parallel to the structural element. As a result, road material such as concrete, macadam or the like, can be inserted between the flange and the upper wall thereby embed the sealing strip.

Preferably the internal supporting walls include at least one pair of inverted V-shaped arms connected at its apex to the apex of the top wall so that on compression of the side wall, the apexes move in an ascending direction.

Full details of the present invention are set forth in the following description and are illustrated in the drawings.

DESCRIPTION OF THE INVENTION

Figure 1:
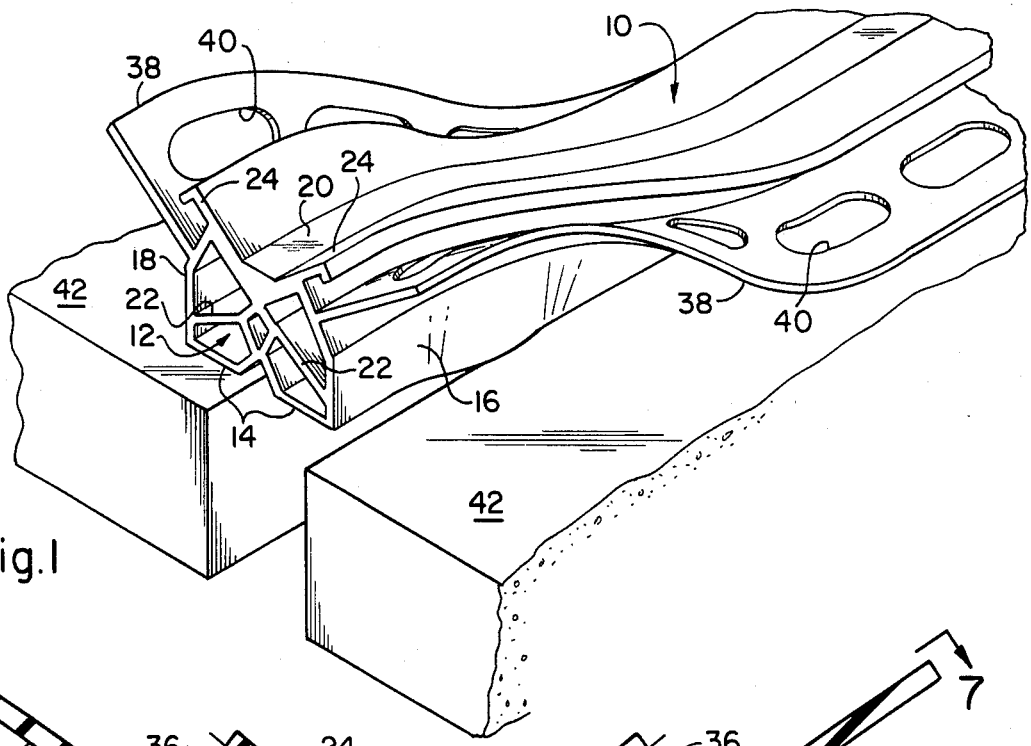
FIG. 1 is a perspective view showing an improved bridge seal being inserted between two flooring elements.
Figure 2:
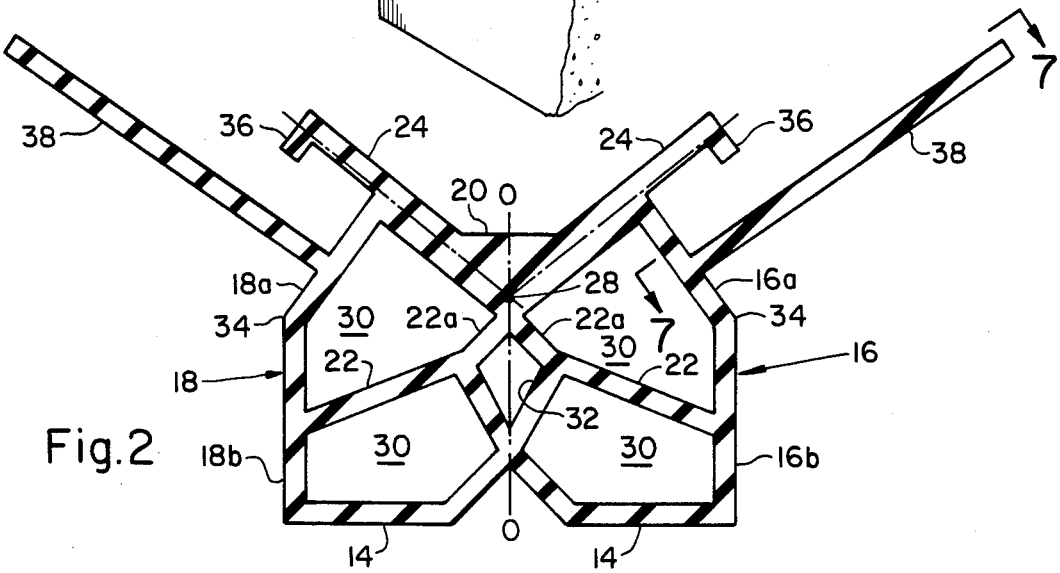
FIG. 2 is a transverse section of the bridge seal shown in FIG. 1 in relaxed condition.

As seen in FIGS. 1 and 2, the seal of the present invention, generally depicted by the numeral 10, comprises an elongated extruded hollow body 12 of generally polygonal cross section. In cross section, the bridge seal is formed of a base wall 14, a pair of oppositely disposed side walls 16 and 18, a top wall 20 and a plurality of internally supporting wall struts 22. The top wall 20 comprises a pair of laterally extending arms 24 which extend at a V-shaped angle to each other.

The base wall 14 and the internal struts 22 are arranged in V-shaped pairs, at least of which, pair 22a, extend in an inverted V with its apex co-incident with the apex 28 of the top wall 20.

The body 12 is thus formed, as seen in FIG. 2, so as to be symmetrical with respect to a vertical plane O—O extending the length of the strip and passing through the apex 28 of the top wall 20. The struts 22 divide the interior of the body 12 into a plurality of voids 30 circumferentially spaced about a central void 32.

As with the forementioned Trieste patent, the struts 22 provide ample supporting strength both during formation and curing and during compression. In addition, the struts 22 provide, unlike the prior Trieste structure, elements which ascend or rise during compression, which lift the center of the top wall to form a horizontal surface, as will be hereinafter describeda plurality of voids 24 circumferentially spaced about a central void 26.

Each of the side walls 16 and 18 is formed so that in the uncompressed state, it is provided with an upper section 16a and 18a respectively and a lower section 16b and 18b respectively. The upper sections "a" are separated from the lower sections "b" by a bend or fulcrum 34. The lower sections "b" extend parallel to each other and parallel to the vertical plane O—O while the upper sections are bent inwardly from the fulcrum 34 toward each other and each extends perpendicularly toward the upper wall 14 approximately midway between the apex 28 and the ends of each arm 24 respectively. The upper wall 14 is relatively thick and enlarged at its apical center, symmetrically to the vertical plane O—O and is provided with a downwardly extending lip 36 at the end along the entire length of each of the arms 24.

Extending outwardly from the center of each of the upper side wall sections 16a and 18a respectively, is a flat flange 38. The flange 38 extends the full length of the seal 12 well beyond the lateral extent of the corresponding lip 36 and is provided with a plurality of anchoring holes or slots 40 spaced along its length.

Figure 3:
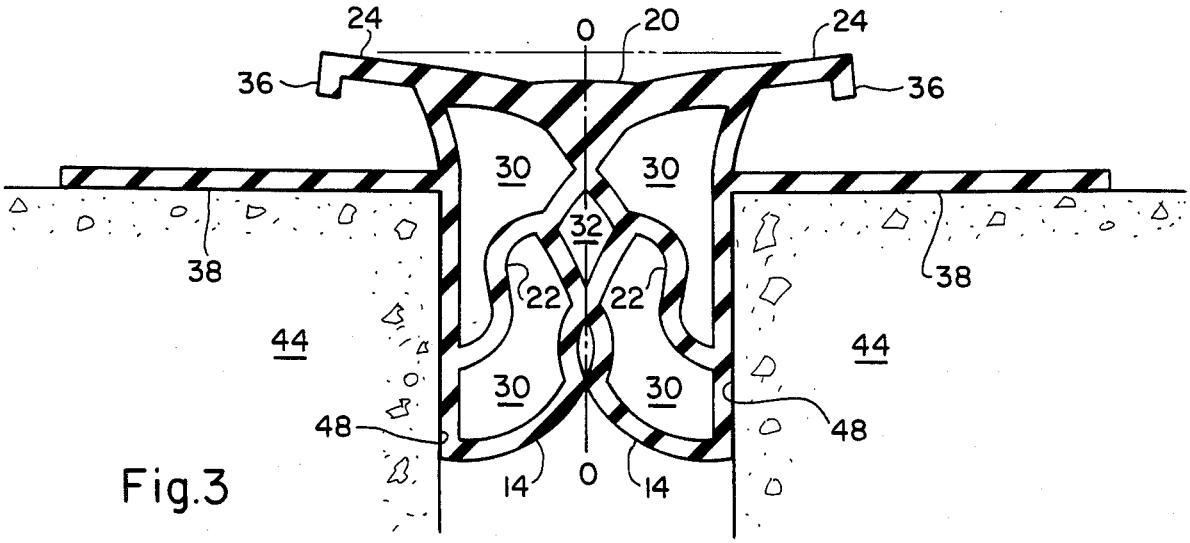
FIG. 3 is a transverse section of the bridge seal shown in FIG. 1 as inserted between the flooring elements.
Figure 4:
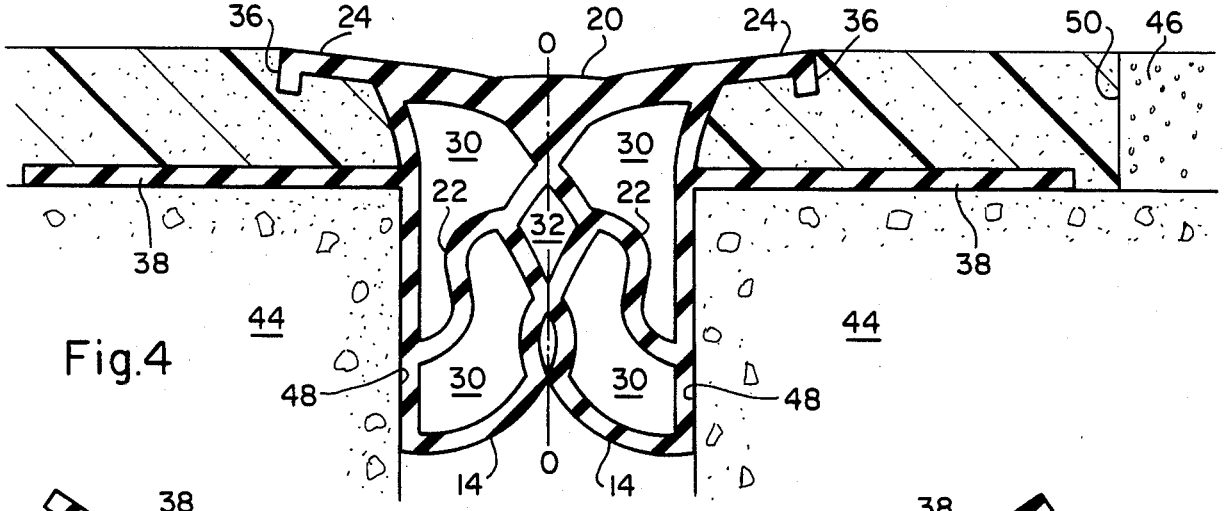
FIG. 4 is a view similar to that of FIG. 3 showing the bridge seal embedded in the grout finishing layer of the flooring elements.

As shown in FIG. 1, the bridge seal 10, is partially in its relaxed state preparatory to insertion between spaced end to end flooring elements 42, and partially in the process of being progressively compressed to effect the proposed insertion. As seen in FIGS. 3 and 4, the flooring elements 42 comprise a base slab 44 generally formed of concrete or other base material, covered by a surface layer 46 of roadway material such as asphalt, macadam, concrete or the like. The surface layer 46 is cut back from the abutting facing edge 48 of the slab 44 to provide a recess 50 into which the top wall arms 24, as well as the flanges 38 fit.

The bridge seal 10 is formed to have an initial transverse width, (i.e: between its parallel side walls 16 and 18) such that, in order for it to be inserted between the slabs 44, the seal strip body 12 must be compressed inwardly toward the central vertical plane O—O, parallel to the side walls 16 and 18 so that the lateral inward compression, causes the simultaneous pivoting of the upper side wall portions 16a and 18a, about the fulcrum 34 in an outward direction. This tends to cause the upper side wall portions 16a and 18a to assume a basically co-planar attitude with respect to the lower portions of the side walls 16b and 18b. Simultaneously, the internal structural supporting struts 22 are compressed with respect to each other and deform into curved shapes, causing the apex 28 of the top wall to ascend or rise pushing the central thickened portion of the top wall 20 upwardly. The upward movement of the central portion of the top wall 20, and the straightening movement of the side walls, causes the top walls 16 and 18, including its laterally extending arms 24 as well as the laterally extending flanges 38, to assume a nearly horizontal position.

In this manner, the bridge seal 10 is inserted between the opposing slabs 44 so that the flanges 38 seat securely on the upper surface thereof. Thereafter, the seal strip 10 is anchored permanently in place by inserting anchoring pins, adhesive or concrete through the anchoring holes 40, or by otherwise securing the extending flanges 38 to the upper surface of the slab 44.

It will be noted at this point, that with the flanges 38 arranged in horizontal position on the surface of the structural elements, that the top wall 20 is also in a generally horizontal position with its lips 36 spaced above the corresponding flanges 38. This provides the opportinity for the finishing layer 46 of the roadway or flooring to be applied. This finishing layer 46 may be generally proceded by the application of a grout 52 i.e. a mixture of sand, stone and epoxy binder placed as is shown in FIG. 4 beneath the lip 36 and the flange 38 to form a shoulder along the length of the strip 12. The grout 52 enters the anchoring holes 40 in the flange 38 and locks the seal strip to the flooring element, and the lip 36 is embedded, as well, into the grout 52. As a last step, an overlay of the surface material 46 i.e. asphalt, concrete or other appropriate material, may be layered over and beyond the grout 52 and feathered so as to be smooth and continuous with each other thereby avoiding any uneven spots about the bridge seal 10.

Also of significant importance, and as best shown in FIG. 3, the flanges 38 are, of course, attached to extend outwardly from each of the seal side walls. Thus, the flanges 38 effectively prevent the seepage of water between the seal side walls and the slab walls 48.

Preferably, the seal 10 is compressed so that the top wall 20 is initially somewhat lower than the feathered surface of the floor to allow for later expansion of the flooring elements 44 and consequent further compression of the seal 10, without raising the central portion of the top wall 20, above the feathered level. Contraction of the flooring elements will allow expansion of the seal 10, but such expansion will be largely taken up by the relaxation of the inner structural wall struts 22 without causing further appreciable depression in the upper wall 20. The lateral flanges 38 and laterally extending lips 36, will also prevent the depression of the top wall even on relaxation of the seal 10 as a whole.

It is to be noted that the upper portion 16a and 18a of the side walls is intended to form a vertical wall following insertion of the seal 10 between the flooring elements. The angle taken by the upper portions "a" with respect to the lower portions "b" at the upper supports of the side walls maintain a more or less perpendicular attitude with respect to the top wall 20. Even under conditions of great compression, the portion of the upper arms 16a and 18a above the flange 38 would tend to bow outwardly increasing the horizontal disposition of the upper surface of the upper wall 20.

Figure 5:
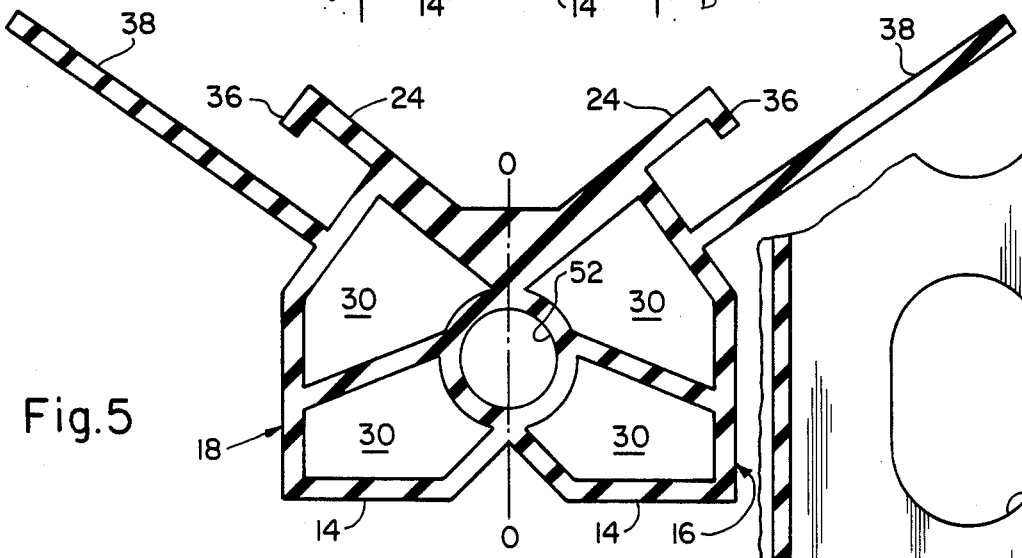
FIG. 5 is a transverse section similar to that of FIG. 2 showing a second embodiment of the bridge seal.
Figure 7:
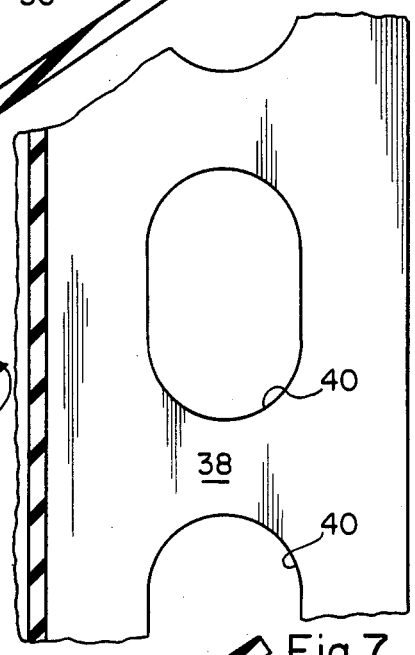
FIG. 7 is a top plan view of the flange of the bridge seal taken in the direction of line 7—7 of FIG. 2.
Figure 6:
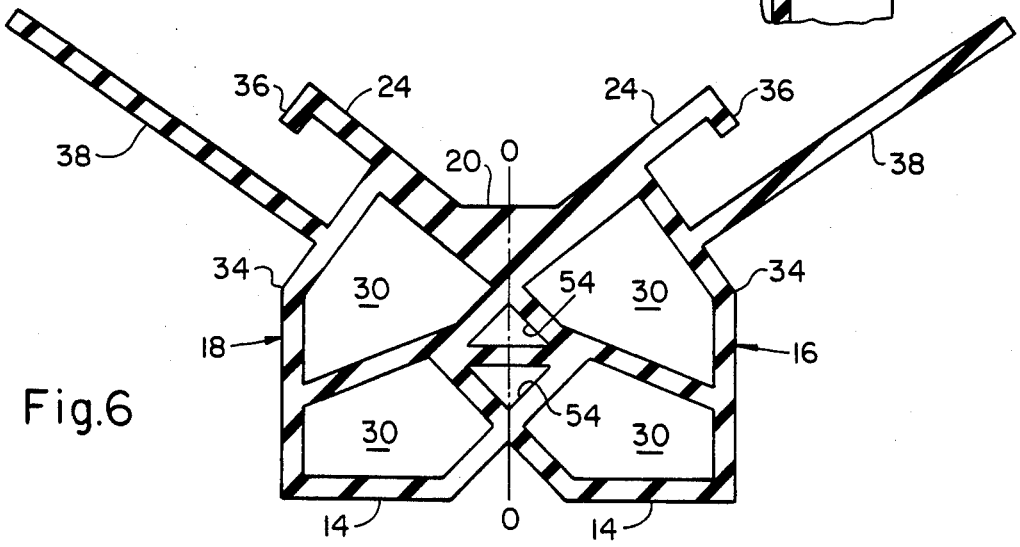
FIG. 6 is a view similar to that of FIG. 5 showing a third embodiment.

In FIG. 5, a further embodiment of the present invention, is shown wherein the internal supporting struts 22 are modified so that instead of the central diamond shape 32 a central void 50, of circular shape, is formed. In FIG. 6, a still further embodiment is shown in which the central void is formed of a pair of triangles 62. In either case, the function and operation of the internal wall structure is not modified at all in that the supporting structure in both additional modifications, have an inverted V shape, the apex of which is coextensive with the apex of the shaped V of the upper wall so that on lateral compression of the bridge seal, the ascent or rise of the apexes is effected causing the rotational movement of the upper wall 20 and the associated lips 36 and flanges 38, is effected.

Various modifications and changes have been suggested herein, others will be apparent to those skilled in the art. Accordingly, it is intended that the present disclosure be taken as illustrative only and not limiting in its scope.

What is claimed is:

1. A bridge seal for bridging the groove or space between structural flooring elements, comprising a pair of spaced apart side walls, each having an upper lever portion extending inwardly from each other at a fulcrum point intermediate its ends, an upper wall connected to be supported on the upper ends of the lever portions having an initial V shaped configuration with outer arm portions extending outwardly of the lever portion and inner portions extending inwardly thereof, connected to each other at a midpoint between the side walls, and an inverted V shaped pair of internal walls connected from the side walls to the midpoint connection adapted when the seal is compressed on the side walls to be moved toward each other to urge the mid point in an ascending direction whereby the inner portions rotate in and the outer portions rotate down to provide a flat configuration to said upper wall.

2. An elastomeric seal comprising an elongated substantially hollow body having a polygonal cross section formed by a bottom wall, a pair of opposed spaced side walls, a top wall having a pair of arms extending in a V with respect to each other and a plurality of internal supporting struts, symmetrically arranged about the center of said polygonal cross section, said side walls being bent inwardly intermediate their ends to have an upper portion extending perpendicular to the respective arms of said top wall, so that on compression of the lower portions of said side walls toward each other, the arms of said top wall are rotated downwardly into a flat configuration.

3. The seal according to claim 2, wherein each of said arms of the top wall is provided with lips extending outwardly therefrom beyond the upper portions of side walls.

4. The seal according to claim 2, including a flat flange extending perpendicularly outward from the upper portion of said side wall intermediate the upper wall and the fulcrum point.

5. The seal according to claim 2, wherein the internal supporting walls include at least one pair of inverted V-shaped arms connected at its apex to the apex of said top wall to urge on compression of said side walls, the apexes in an ascending direction.

6. An elastomeric expansion joint for roadway constructions, having a pair of end to end spaced slabs, each of which expand and contract under thermal variation, comprising an elastomeric seal having an elongated substantially hollow body of polygonal cross section formed by a bottom wall and a pair of opposed spaced side walls, a top wall having a pair of arms extending in a V with respect to each other, and a plurality of internal supporting walls symmetrically arranged about the center of said polygonal cross section, said side walls being bent inwardly intermediate their ends, having their upper free ends connected perpendicularly to the respective arms of said top wall, said sealing strip being inserted in the space between said structural elements by compressing the side walls laterally toward each other, said compression causing the inwardly bent arm portions of the side walls to extend vertically from the remainder of the side walls and to cause the top wall to rotate into a flat configuration.

* * * * *